US009284170B2

(12) United States Patent
Guimarães

(10) Patent No.: US 9,284,170 B2
(45) Date of Patent: Mar. 15, 2016

(54) DEVICE FOR REMOVING HOPPERS FROM RAIL CARS

(71) Applicant: VALE S/A, Rio de Janeiro (BR)

(72) Inventor: Célio Antonio Guimarães, Itapecirica (BR)

(73) Assignee: VALE S.A., Rio de Janeiro (BR)

( * ) Notice: Subject to any disclaimer, the term of this patent is extended or adjusted under 35 U.S.C. 154(b) by 0 days.

(21) Appl. No.: 13/951,267

(22) Filed: Jul. 25, 2013

(65) Prior Publication Data

US 2014/0027692 A1 Jan. 30, 2014

(30) Foreign Application Priority Data

Jul. 25, 2012 (BR) ..... 102012018472

(51) Int. Cl.

| | |
|---|---|
| ***B66D 3/14*** | (2006.01) |
| ***B66D 1/28*** | (2006.01) |
| ***B66D 3/02*** | (2006.01) |
| ***B66D 1/04*** | (2006.01) |

(52) U.S. Cl.

CPC .. *B66D 1/28* (2013.01); *B66D 1/04* (2013.01); *B66D 3/02* (2013.01); *B66D 3/14* (2013.01)

(58) Field of Classification Search

CPC ..... B65G 65/23; B65G 67/24; B61D 7/00; B61D 9/14; B61D 9/00; B66D 3/14; B66D 3/02

USPC ..... 254/398–400

See application file for complete search history.

(56) References Cited

U.S. PATENT DOCUMENTS

| | | | | | |
|---|---|---|---|---|---|
| 31,077 | A | * | 1/1861 | Doyle | 254/399 |
| RE4,971 | E | * | 7/1872 | Weston | 254/393 |
| 173,309 | A | * | 2/1876 | Lipsey | 254/399 |
| 723,434 | A | * | 3/1903 | Arsneau | 254/399 |
| 889,488 | A | * | 6/1908 | Smith | 254/399 |
| 1,216,545 | A | * | 2/1917 | Burgess | 191/44.1 |
| 1,422,174 | A | * | 7/1922 | Boettcher | 254/391 |
| 1,614,697 | A | * | 1/1927 | Snook | 414/467 |
| 1,764,512 | A | * | 6/1930 | Hume | 254/391 |
| 2,183,478 | A | * | 12/1939 | Holmes et al. | 414/563 |
| 2,351,665 | A | * | 6/1944 | Coffing | 254/335 |
| 2,608,107 | A | * | 8/1952 | Robins et al. | 74/578 |
| 2,808,911 | A | * | 10/1957 | McLerran | 52/119 |
| 2,936,085 | A | * | 5/1960 | Schnaitter et al. | 414/386 |
| 3,003,359 | A | * | 10/1961 | Maasdam | 74/142 |
| 3,583,335 | A | * | 6/1971 | Schilf et al. | 105/377.05 |
| 3,648,978 | A | * | 3/1972 | Ratcliff | 254/376 |
| 3,741,528 | A | * | 6/1973 | Profet | 254/333 |
| 3,767,230 | A | * | 10/1973 | DeVries | 280/477 |
| 3,985,342 | A | * | 10/1976 | Denman | 254/335 |
| 4,003,551 | A | * | 1/1977 | Wallace | 254/335 |

(Continued)

FOREIGN PATENT DOCUMENTS

GB 190307990 A 0/1903

*Primary Examiner* — Emmanuel M Marcelo
*Assistant Examiner* — Michael Gallion
(74) *Attorney, Agent, or Firm* — Arent Fox LLP

(57) ABSTRACT

There is described a device for removing a drawer-type hopper of a railroad car, the device comprising: a first support base positioned on a platform and a second support base supported on the railroad car; and a tackle fastened on the first support base; the tackle comprising a first hook associated to the drawer-type hopper, the first hook and the drawer-type hopper being moved linearly by the tackle in the opposite direction of the railroad car.

6 Claims, 2 Drawing Sheets

(56) References Cited

U.S. PATENT DOCUMENTS

| | | | | | |
|---|---|---|---|---|---|
| 4,084,794 | A * | 4/1978 | Wallace | 254/399 |
| 4,497,259 | A * | 2/1985 | Titterton | 105/359 |
| 4,585,178 | A * | 4/1986 | Arzt | 241/23 |
| 4,604,023 | A * | 8/1986 | Musschoot | 414/375 |
| 4,696,237 | A * | 9/1987 | Miller | 105/248 |
| 4,795,301 | A * | 1/1989 | Snead et al. | 414/339 |
| 5,054,745 | A * | 10/1991 | Swayze et al. | 254/325 |
| 5,080,548 | A * | 1/1992 | Bratlie et al. | 414/385 |
| 5,435,450 | A * | 7/1995 | Delcambre | 213/100 R |
| 5,560,441 | A * | 10/1996 | Moody et al. | 180/7.5 |
| 5,603,489 | A * | 2/1997 | Regal | 254/378 |
| 6,138,992 | A * | 10/2000 | Bell | 254/326 |
| 6,502,518 | B1 * | 1/2003 | Miller | 105/248 |
| 6,508,456 | B2 * | 1/2003 | Hulburd et al. | 254/218 |
| 6,527,405 | B2 * | 3/2003 | Hsieh | 362/119 |
| 6,793,201 | B2 * | 9/2004 | Harrah et al. | 254/108 |
| 6,835,041 | B1 * | 12/2004 | Albert | 414/386 |
| 6,966,741 | B2 * | 11/2005 | Gay et al. | 414/662 |
| 7,114,909 | B2 * | 10/2006 | McCrory et al. | 414/809 |
| 2004/0245030 | A1 * | 12/2004 | Holtan et al. | 180/19.1 |
| 2006/0000384 | A1 | 1/2006 | Taylor | |
| 2007/0089638 | A1 * | 4/2007 | Taylor | 105/247 |
| 2008/0246011 | A1 * | 10/2008 | Heravi et al. | 254/266 |
| 2014/0246290 | A1 * | 9/2014 | Mast et al. | 198/562 |

* cited by examiner

DEVICE FOR REMOVING HOPPERS FROM RAIL CARS

CROSS-REFERENCE TO RELATED APPLICATION

This application is based upon and claims the benefit of priority of the Brazilian Patent Application No. PI 102012018472-9, filed Jul. 25, 2013, the disclosure of the prior application is hereby incorporated in its entirety by reference.

The present invention refers to a device for removing hoppers in a bulk railroad car, particularly draw-type hoppers, after unloading the load.

DESCRIPTION OF THE STATE OF THE ART

Certain railroad cards comprise drawer-type hoppers, used for unloading the transported load, especially bulk cars.

During maintenance of these bulk cars, there is a notable need to change the drawer-type hopper and, in such cases, the hopper is removed in a dangerous and time-consuming manner, with the use of blowtorches and mallets, demanding extreme physical effort from the professional and retaining the car in the maintenance for a very long period of time.

Therefore, it is not known from the prior art a device for removing drawer-type hoppers from bulk cars in an efficient and safe manner. Devices applied to hoppers already known in the state of the art are designed to assist or facilitate unloading, but not the removal thereof from the car. In this sense, document G8190307990, for example, describes a mechanism to operate lower doors of hopper cars for unloading the material inside them. This mechanism comprises an articulation fixed to the door and a pulley, linked to this articulation by means of a chain. However, this document does not teach the removal of draw-type hoppers.

Document US2007/089638 describes a mechanism for automatically opening or closing the covers of hopper railroad cars. This mechanism is formed by articulated bars which contact the covers for unloading the content of the cars. Despite achieving the aim of automatically operating the hopper covers, this mechanism is not used to remove drawer-type hoppers in a railroad car.

Document US2006/000384 refers to a system for automatically operating hopper doors. This system is formed by articulated arms and actuating cylinders. However, just like the mechanism above, this system is only for opening hopper doors.

OBJECTIVES OF THE INVENTION

The objective of the present invention is to provide a device for removing a drawer-type hopper of a railroad car in a safe, practical, rapid and efficient manner, reducing the time to replace this hopper and, consequently, reducing the downtime of the car for maintenance.

BRIEF DESCRIPTION OF THE INVENTION

The object of the invention is a device for removing a drawer-type hopper from a railroad car, the device comprising: a first support base positioned on a platform and a second support base supported on the railroad car; and a tackle fastened on the first support base; the tackle comprising a first hook associated to the drawer-type hopper, the first hook and the drawer-type hopper being moved linearly by the tackle in the opposite direction of the railroad car.

DESCRIPTION OF THE DRAWINGS

The present invention will now be described in greater detail based on an example of execution represented in the drawings. The drawings show.

DETAILED DESCRIPTION OF THE DRAWINGS

Figure 1:
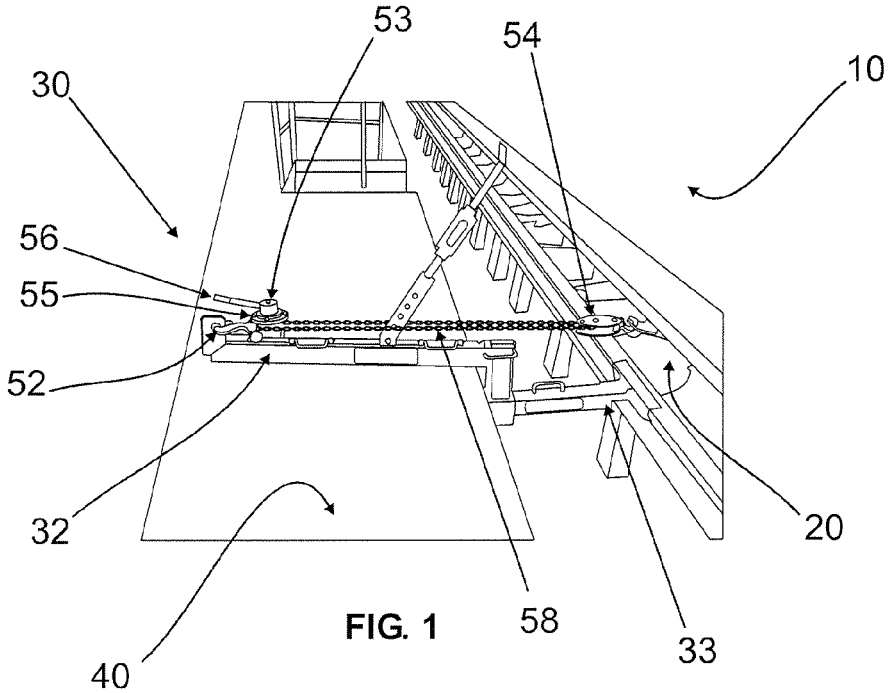
FIG. 1—is a front view of the device that is the object of the present invention.

According to a first embodiment and as can be seen as of FIG. 1, the present invention refers to a mechanical device 30 for removing a drawer-type hopper 20 of a railroad car 10.

This device 30 comprises a first support base 32 positioned on a platform 40 and a second support base 33 supported on the railroad car 10, both preferably manufactured with hardened metallic profiles.

Figure 2:
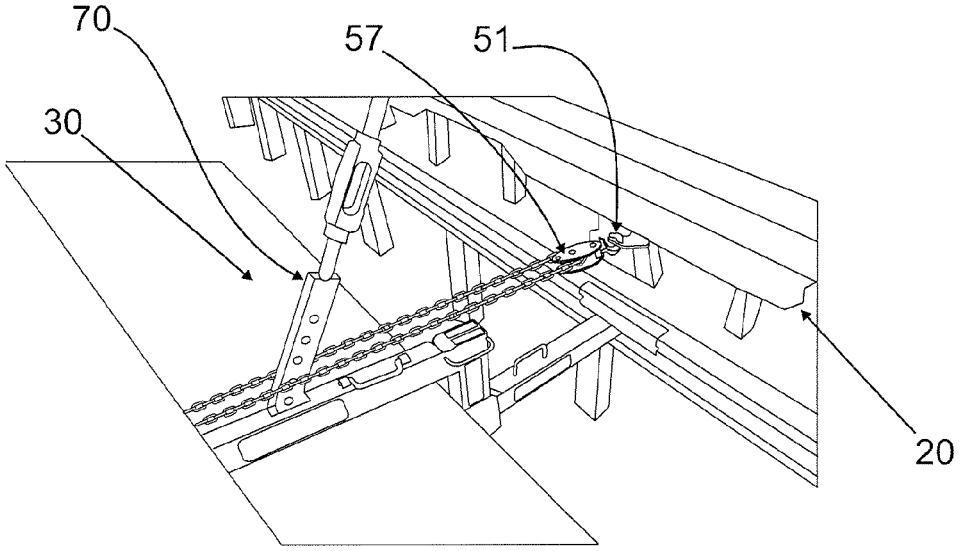
FIG. 2—is a detailed view of the action of the device, object of this invention, in the drawer-type hopper.
Figure 3:
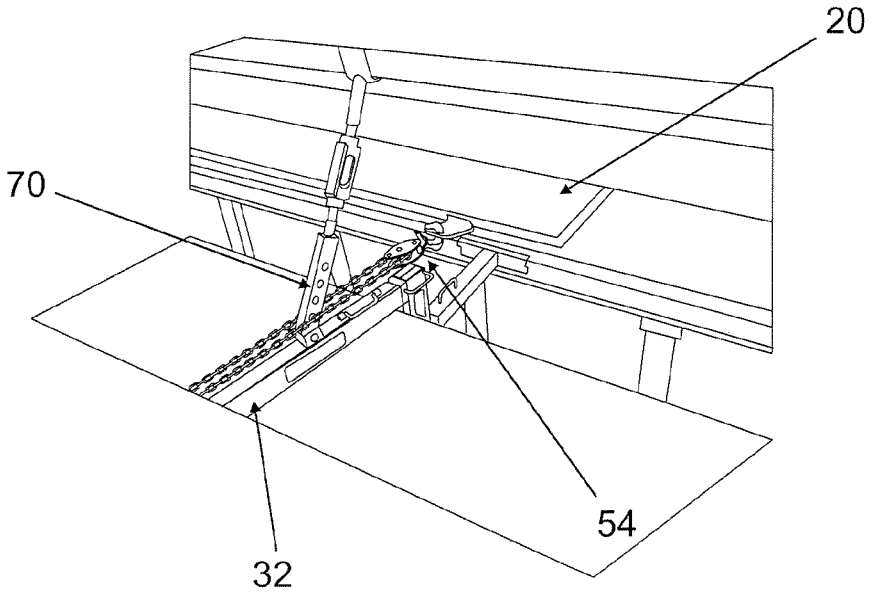
FIG. 3—is a detailed view of the device, object of this invention, removing the drawer-type hopper from the railroad car.
Figure 4:
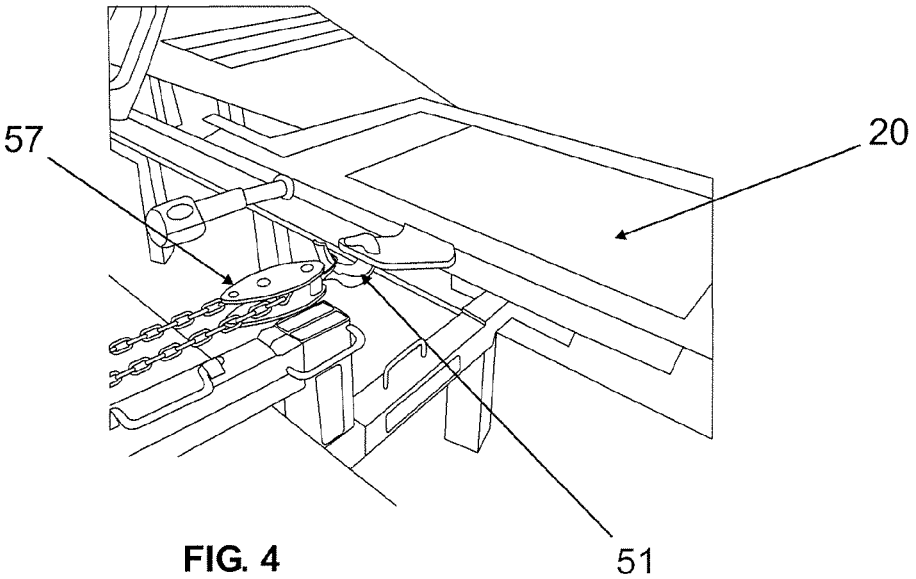
FIG. 4—is a detailed view of the device, object of this invention, finalizing the removal of the drawer-type hopper from the railroad car.

The device 30 further comprises a tackle 50 fastened on the first support base 32. As illustrated in FIG. 1 and in the details of FIGS. 2 to 4, the tackle 50 contains a drag mechanism 54 fastened to the drawer-type hopper 20 by means of a first hook 51 and an arm mechanism 53 fastened on the first support base 32 by means of a second hook 52.

The arm mechanism 53 is formed by a turnstile 55 driven by an arm 56. The drag mechanism 54 is formed by a pulley 57 fastened to the first hook 51. A chain 58 cooperatively associates the arm mechanism 53 to the drag mechanism 54. The chain 58 is inserted into the turnstile 55 and passes through the groove of the pulley 57, whereby the chain 58 is coiled around the body of the turnstile 55 when driven.

The device 30 also comprises a supporting element 70 disposed substantially concurrent to the first support base 32 and supported on the railroad car 10.

When it is necessary to change the drawer-type hopper 20 of a bulk railroad car 10, this car 10 is parked next to a maintenance platform 40. The device 30 for removing the drawer-type hopper 20 of a railroad car 10, the object of this invention, is positioned next to the car 10 such that the first support base 32 of the device 30 is positioned on a platform 40 and the second support base 33 is supported on the railroad car 10. Additionally, the supporting element 70 is also supported on the car 10, preferably on the corner of the juncture of the side wall with the bottom or floor of the car 10.

Once the device 30 is firmly positioned, the arm mechanism 53 is fastened on the first support base 32 of the device by way of the second hook 52. Optionally, the arm mechanism 53 may be fastened to the first support base 32 of the device 30 before positioning this device 30 on the platform 40.

Next, the pulley 57 of the drag mechanism 54 is associated to the drawer-type hopper 20 by encasing the first hook 51 in an eyelet contained in the drawer-type hopper 20, finalizing the assembly of the device 30 as illustrated in FIG. 1.

The operator moves the arm 56 rotating the turnstile 55. In being rotated, the turnstile 55 drives the chain 58 which coils around the body of the turnstile 55, and during the recoiling of the chain 58 there occurs traction of the drag mechanism 54. As the drag mechanism 54 is associated to the hopper 20 by means of the first hook 51, the first hook 51 and the drawer-type hopper 20 are moved linearly by the tackle 50 in the opposite direction of the railroad car 10, that is, in the direction of removing the drawer-type hopper 20 from its compartment in the railroad car 10.

During this hopper 20 removal procedure, the supporting element 70 prevents the first support base 32 from losing contact with the platform 40 while traction force is being applied to the chain 58 and to the drag mechanism 54 by the arm mechanism 53.

With the use of this device 30, the time spent on removing hoppers 20 from railroad cars 10 is significantly reduced from 40 minutes to 10 minutes. This generates an increase in productivity. Using methods already known in the state of the art, the production capacity is 8 hoppers removed from 2 cars per day. The use of the device 30, object of this invention, enables production of replacing 24 hoppers removed from 6 cars per day. Consequently, the car retention time for replacing the hoppers is already reduced, whereby increasing the productivity index.

Additionally, the device 30 provides much more safety in the activity, since mallets and blowtorches are not used.

Having described an example of a preferred embodiment, it must be understood that the scope of the present invention encompasses other possible variations, being limited only by the content of the accompanying claims, potential equivalents being included therein.

The invention claimed is:

1. A device for removing a drawer-type hopper from a railroad car, the device comprising:

a first support base having a bottom surface configured to be positioned on a horizontal platform;

a second support base having an end configured to be supported on the railroad car;

a base extension having a body that connects the first support base to the second support base at a fixed distance;

a drag mechanism fastenable to the drawer-type hopper;

an arm mechanism fastened to the first support base;

a linking mechanism coupling the drag mechanism to the arm mechanism, wherein operation of the arm mechanism drives the linking mechanism to translate the drag mechanism and the drawer-type hopper toward the first support base linearly along a horizontal plane; and a supporting element fixed to the first support base and fastenable to the railroad car in an angular orientation relative to the horizontal plane.

2. The device as claimed in claim 1, wherein the arm mechanism is positioned above the base extension and fastened on the first support base by a first hook, and wherein the drag mechanism comprises a second hook for fastening the drag mechanism to the drawer-type hopper.

3. The device as claimed in claim 2, wherein the arm mechanism comprises a turnstile driven by an arm, the drag mechanism comprises a pulley, and the linking mechanism comprises a chain.

4. The device as claimed in claim 1, wherein the supporting element has a length configured to maintain contact of the first base with the platform.

5. The device as claimed in claim 1, wherein the body of the base extension includes a first extension portion and a second extension portion each extending in a horizontal direction, and a third extension portion extending in a vertical direction and connecting an end of the first extension to an end of the second extension.

6. The device as claimed in claim 5, wherein the third extension portion is configured to engage a side of the platform.

* * * * *